US008092322B1

(12) United States Patent
Smallcomb et al.

(10) Patent No.: US 8,092,322 B1
(45) Date of Patent: Jan. 10, 2012

(54) BUNT GUARD

(76) Inventors: Kevin Smallcomb, Greeley, CO (US); Terry Endres, Ft. Collins, CO (US)

( * ) Notice: Subject to any disclaimer, the term of this patent is extended or adjusted under 35 U.S.C. 154(b) by 0 days.

(21) Appl. No.: 12/807,281

(22) Filed: Sep. 1, 2010

Related U.S. Application Data

(60) Provisional application No. 61/276,074, filed on Sep. 8, 2009.

(51) Int. Cl.
*A63B 69/00* (2006.01)

(52) U.S. Cl. ..... 473/451

(58) Field of Classification Search ..... 473/451, 473/457, 422; 119/817; 2/16, 22; 602/6
See application file for complete search history.

(56) References Cited

U.S. PATENT DOCUMENTS

| | | | | | |
|---|---|---|---|---|---|
| 737,186 | A | * | 8/1903 | Williams | 119/817 |
| 2,338,424 | A | * | 1/1944 | Giardini | 2/22 |
| 4,011,596 | A | * | 3/1977 | Chang | 2/16 |
| D334,085 | S | * | 3/1993 | Niemann | D29/113 |
| 5,307,521 | A | * | 5/1994 | Davis | 2/22 |
| 5,360,394 | A | * | 11/1994 | Christensen | 602/26 |
| 5,722,092 | A | * | 3/1998 | Borzecki et al. | 2/16 |
| 6,128,777 | A | * | 10/2000 | Foreman | 2/16 |
| 6,186,909 | B1 | | 2/2001 | Swanson, Jr. | |
| 7,540,813 | B2 | * | 6/2009 | Liberatore | 473/457 |

* cited by examiner

*Primary Examiner* — Gene Kim
*Assistant Examiner* — M Chambers
(74) *Attorney, Agent, or Firm* — James K. Poole, Esq.

(57) ABSTRACT

A bunt guard 1 that easily attaches to all baseball and softball bats during bunting practice. A protective shield 2, durable and deflective by design, protects the bunter's hands 10 and fingers 12 from erratic pitches, or slow reaction. The shield 2 attaches and detaches quickly with straps 5 B holding the bunt guard 1 in its desired location.

3 Claims, 4 Drawing Sheets

BUNT GUARD

CROSS REFERENCE TO RELATED APPLICATION

This application relates to the subject matter of provisional patent application 61/276,074, filed Sep. 8, 2009, from which priority is claimed.

BACKGROUND

1. Field of the Invention

This invention relates to the field of baseball-softball training devices and safety equipment. This guard, which easily attaches to any ball bat during bunting practice, protects the "barrel hand" and fingers near the contact point of a pitched ball.

2. Description of Relevant Art

When a bunting situation arises in a game, the bunter usually has one or maybe two attempts to lay down a good bunt. During bunting practice, a player must lay down many successful bunts, down the first base line and third base line, before a coach takes the next player, for his or her turn. Because of many more repetitions during practice, this is when a good protective device is needed. The anxiety many players feel while bunting can be removed, if proper skills are learned in a safe manner. Pitching machines and practice pitchers can both be erratic and potential injury is a reality, without this product. The approach of a pitching machine ball varies on how the machine was loaded, who made the machine, or if old scarred balls were used. If the machine was loaded as a pitcher would throw a 2-seam fastball, or a 4-seam fastball, the trajectory would vary, and if it came in like a knuckle ball—it would change direction, or even corkscrew in mid-flight.

A Major League or college age pitcher can throw 95 mph fastballs, and at that speed it takes 0.4 seconds to travel 60' 6"—giving the batter 0.2 seconds to decide to hit, bunt or let it pass. Developing eye-brain-body coordination is learned by going through the motion over and over; fortunately for developing bunting skills, it can be accomplished safely, with the bunt guard.

Some natural athletes have the speed, power and defensive abilities to be great players. Most still need much training and experience to become skilled bunters. Some players will never have the speed, power or arm strength of others, but they can develop the fine aspect of bunting. Sometimes it's the small details that makes you a starter, or puts you on the team.

U.S. Pat. No. 6,186,909, attempted to solve the hand protection issue, for use during bunting practice. If it had actually been produced, it would have fit only a very small percentage of bats made, in the proper location. The cantilevered design feature would have tilted the guard into the hand it was designed to protect.

SUMMARY

A bunt guard is designed to protect a baseball or softball player's hand and fingers during bunting practice. There are thousands of different ball bats; metal and wood, different lengths and diameters, with varying degrees of tapers between the thin handle area and the thick barrel area. This guard attaches to virtually every standard ball bat, in the proper location for each bunter, in an easy and secure fashion, utilizing hook and loop straps, preferably applied with a non-slip surface on the bat side. The bunt guard comes with pre-attached hook and loop straps, so it is quick and easy to slip the bat handle between the strapping and shield, and tighten the strapping for attachment to the bat. The durable and light weight shield protects the bunter's 29 hand bones, ligaments and tendons, as well as deflecting balls away from the bunter's body and face, if the guard is hit by an errant pitch. The safety provided by the guard builds confidence in the player, creating a more skilled bunter.

Figure 1:
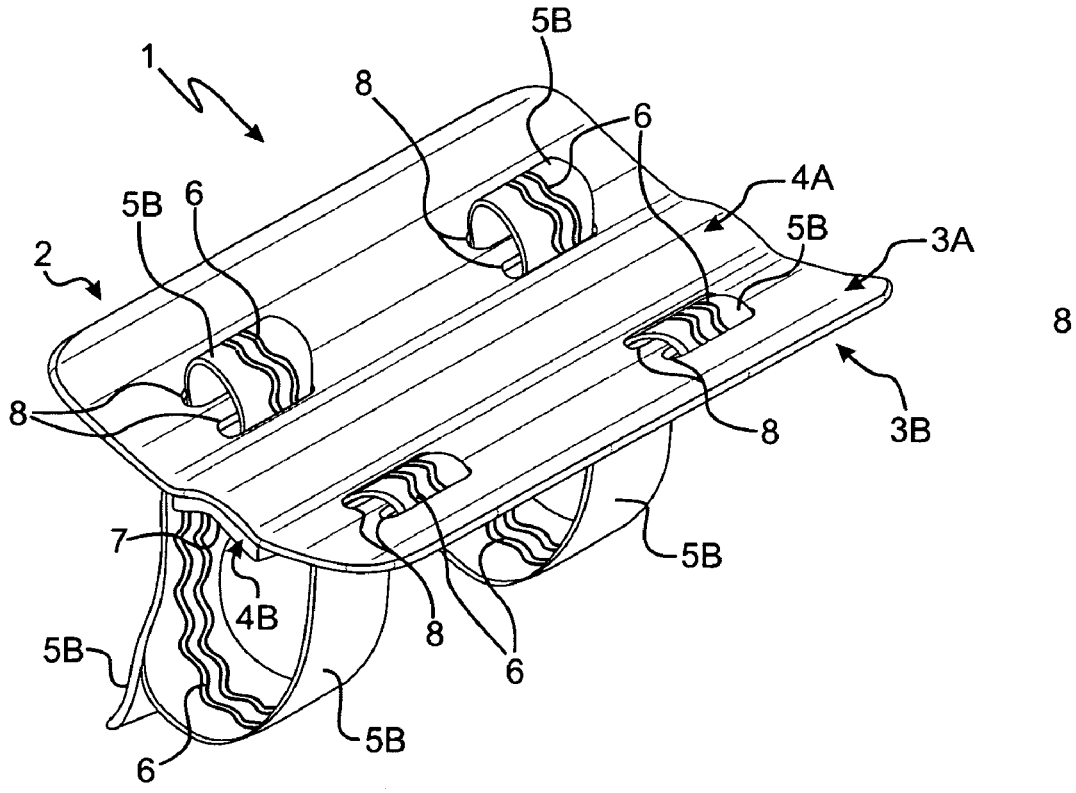
FIG. 1 is a front side perspective view of the bunt guard, showing all of the components assembled.
Figure 2:
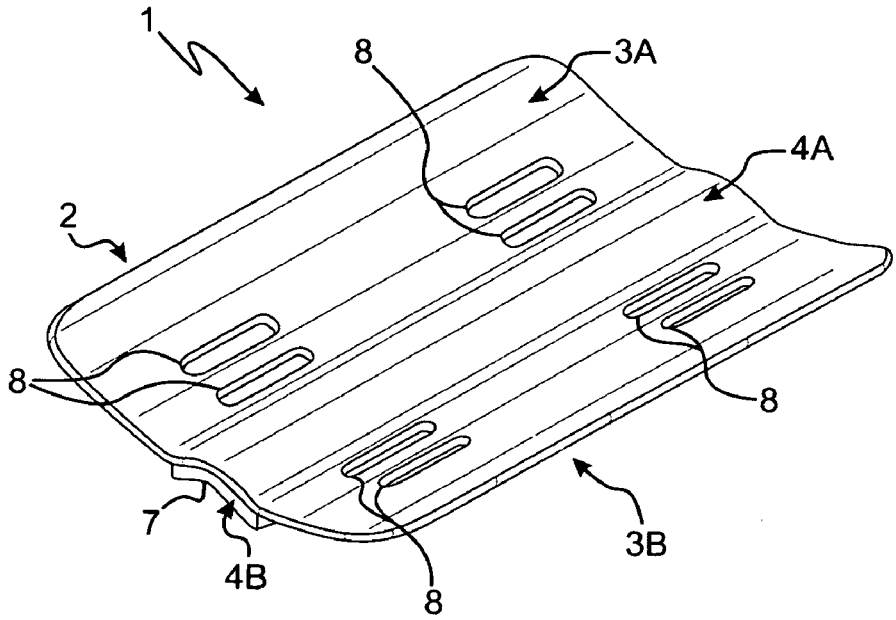
FIG. 2 is a front side perspective view of the shield component.
Figure 3:
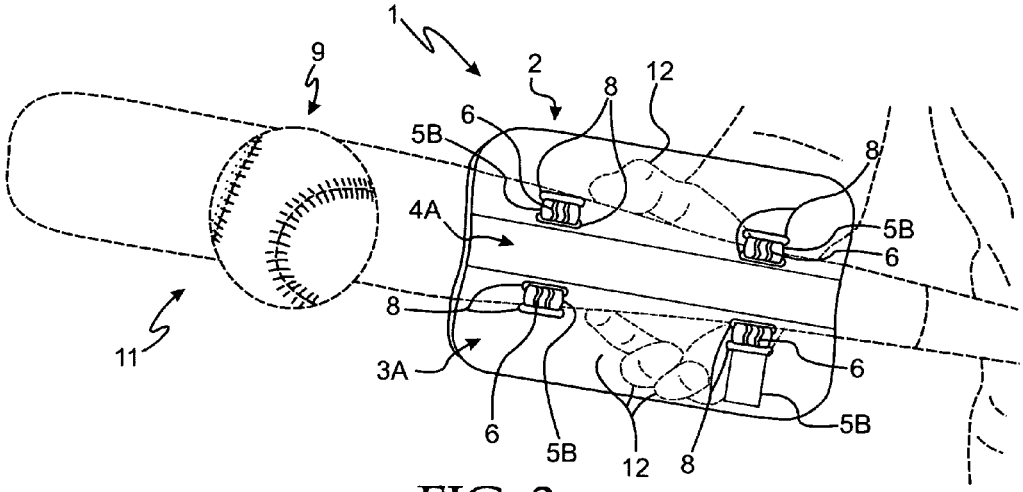
FIG. 3 is a front view of the assembled bunt guard, showing it attached to a ball bat.
Figure 4:
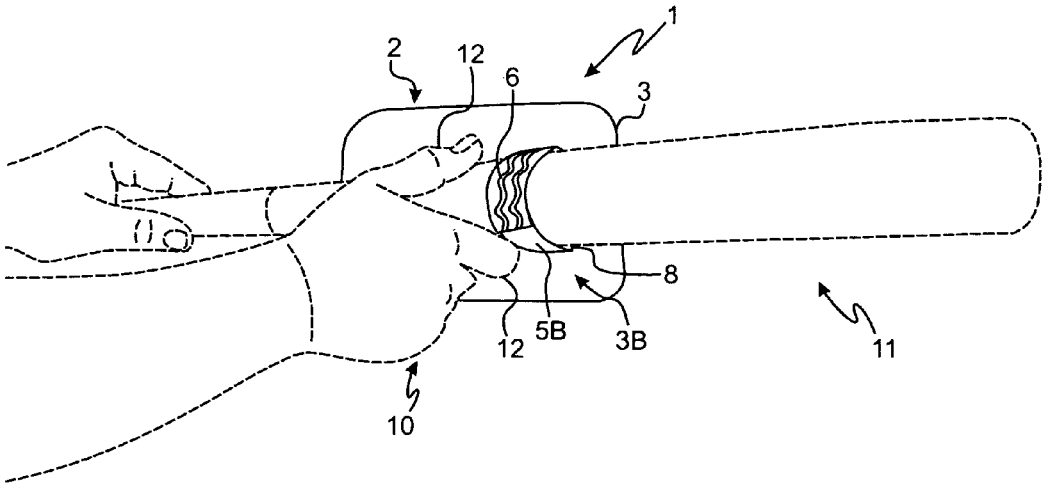
FIG. 4 is a back side perspective view of the bunter's hands on a bat with the bunt guard installed, with the protected barrel hand behind the bunt guard.
Figure 5:
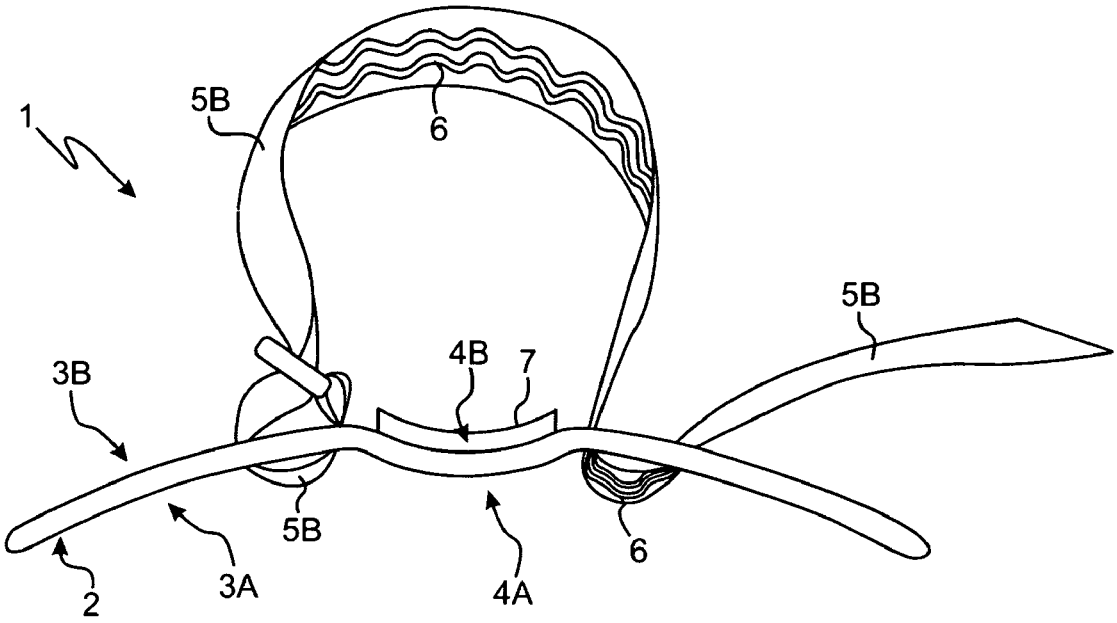
FIG. 5 is a side view of the assembled bunt guard components.
Figure 6:
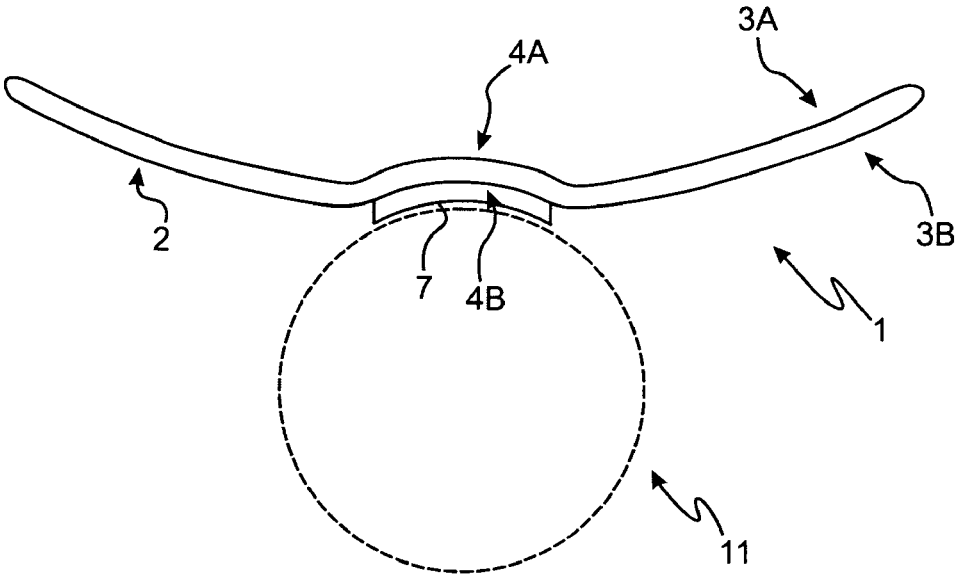
FIG. 6 is a side view of the shield component.
Figure 7:
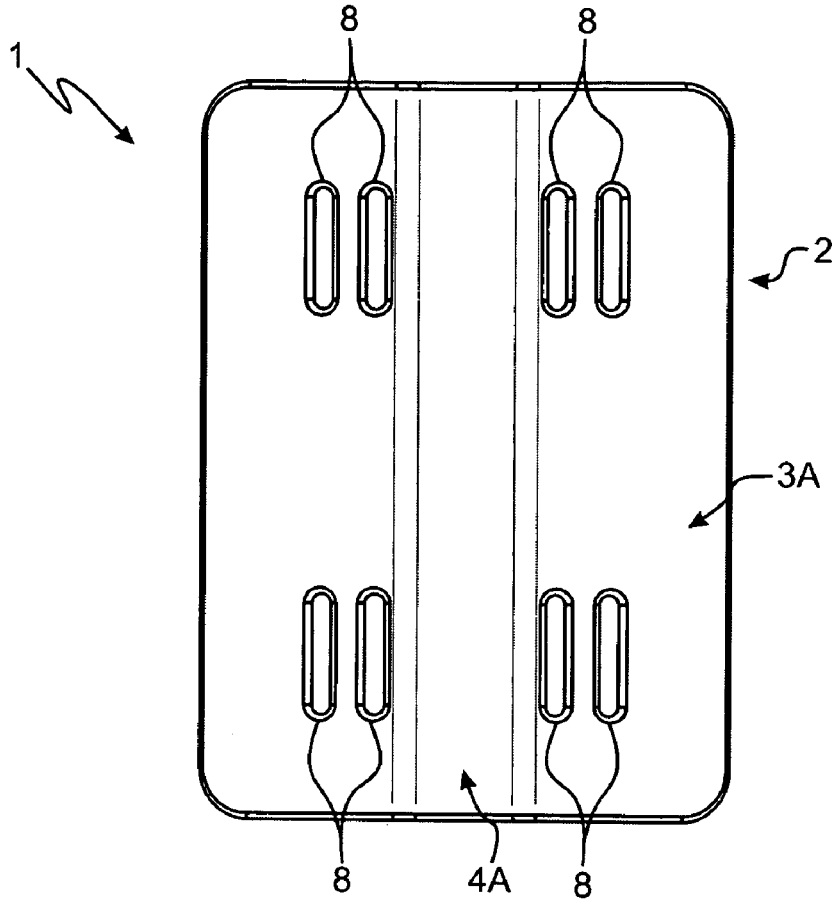
FIG. 7 is a plan view of the shield.
Figure 8:
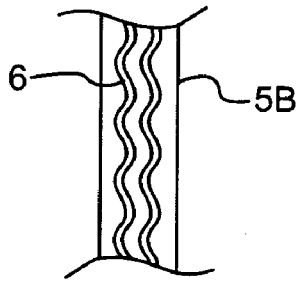
FIG. 8 is a plan view of a section of hook and loop strapping with a non-slip coating on the strapping back side.

As shown in FIGS. 5 and 6, the drawings show two curves: the deflective curve which is convex from the bat surface, and the bat mating curve which is concave to the ball bat surface. The bat mating curve, located in the center of the guard, mates it to the front face of the ball bat, and a larger opposite direction curve deflects balls away from the practice bunter, while saving the hand and fingers from potential injury. The design elements built into the shield, protect the bunters barrel hand and fingers, deflect the ball away, and provide for easy attachment of the hook and loop strapping, while keeping it aligned with the ball bat, with a minimal amount of polymeric material. The bat mating curve surface can have a non-slip shock absorbing cushion adhered to the back side of the shield where it mates to the ball bat, reducing vibration if hit. It also helps to keep the shield securely attached to the ball bat, in its desired location. The risk of injury to a bunters hand or fingers is a reality, and this safety and training device removes the fear factor for many players. The bunt guard helps teach proper bunting techniques in a much safer manner. One aspect of the present invention is a device which can be removably attached to a portion of a ball bat (i.e., a bat for softball and/or baseball) for use in bunting practice. Another aspect is a surface of the device opposite the side attached to the ball bat, designated the "front" surface, which will deflect any ball which strikes that surface of the device. The device should be attachable to the bat in a position which will deflect a ball striking it during bunting practice, without interfering with the normal grip of the player attempting to bunt.

Embodiments of the device, which can be called a bunt guard, comprise a shield portion adapted for one side, designated the back side, to be removably attached to a portion of a ball bat, preferably near the barrel where a player would grip it for bunting, and an opposite side, designated the "front" side, curved or otherwise configured in a manner which will deflect any ball striking that side of the shield. The shield can be made of any suitable impact resistant material, but can be conveniently formed from sheets or other forms of bendable or moldable material such as sheet metal and polymeric materials, thermoplastic or thermosetting, including composite materials containing reinforcing fibers or the like. A preferred material is a polycarbonate. The shield portion (in a flat, planar form before bending, molding or forming) can be substantially rectangular, with two side edges and two end edges shorter than the side edges, designed to be removably fastened to a bat with the side edges substantially parallel to the bat. Means are provided for removably attaching the shield portion to the bat, preferably including an arcurate longitudinal recess, groove or the like having a radius suitable for secure attachment to a portion of a bat. To make the attachment more secure and absorb the shock of the impact of a ball striking the shield portion, the recess or groove can contain a lining or pad having nonskid and shock absorbent properties, such as a layer of a polymeric foam.

The shield portion can be fitted to a portion of a bat and secured there by any suitable mechanical means, for example at least two straps. Two straps have been found to be effective in attaching the shield securely while allowing ample space for the player's fingers to grasp the bat. The guard is preferably designed and attached to a bat so that the two straps and the back side of the shield portion guide the bunter's "barrel" hand to a predetermined best location for bunting, thereby achieving optimum training for bunting in actual play. The strap(s) can be fastened to the shield portion and tightened on the other side of the bat, preferably by providing the strap(s) with at least one surface of hook-and-loop material which allows the ends of each of the strap(s) to be securely adhered to itself after tightening. Materials having the hook-and-loop functions both included on one side can be conveniently used. The straps can also comprise at least one nonslip surface to ensure that the bat is more securely gripped where they come into contact. The strap(s) can be attached to the shield portion by any suitable mechanical means, including slots in the shield through which the straps can be passed. One embodiment provides two or more sets of slots, with pairs of slots on either side of the recess for fitting to the bat and parallel thereto, so that the straps can be passed through the slots, encircle the bat and be secured on the side of the bat opposite the shield portion.

A suitable device effective in being securely but removably attached to a portion of a ball bat and also in deflecting any ball which strikes the exposed surface of the shield can include a shield portion comprising a sheet of polymeric material which is molded or formed to comprise compound curves on each surface. The surface for attachment to the bat contains the longitudinal recess or groove for attachment to the bat, with the adjacent portions of the surface forming convex curvatures. The opposite surface can include a convex-curved portion along the center of the surface corresponding to the recess or groove on the opposite surface, with concave-curved portions extending along both sides of the convex-curved portion. The convex and concave-curved portions are shaped so as to readily deflect any ball striking the exposed surface of the shield.

Additional aspects, advantages and embodiments of the present invention are described in, and will be apparent from, the following detailed description of preferred embodiments together with the drawings and appended claims.

DETAILED DESCRIPTION OF PREFERRED EMBODIMENTS

The main component of the bunt guard 1 is the protective shield 2, which is made of a light weight durable plastic material like polycarbonate or polymer variations similar to it, possibly including strengthening fibers and the like. The shield 2 component will be molded or formed into a compound curve shape, with the deflective curve 3B making up the majority of the surface. That convex deflective curve 3B, shaped opposite of the ball bat front surface, runs longitudinally with the ball bat it is mounted to, and it deflects balls away from the player if it is hit. A second smaller concave curve 4B is molded in the opposite direction, running longitudinally down the center of the shield 2, between the strap slots 8. Its function is to mate the shield 2 to the curvature of the ball bat 11, keeping it aligned with the ball bat. Additionally, the ball bat mating curve 4B is covered with a neoprene shock absorbing impact cushion 7, with non-slip and vibration absorbing properties. Its compression deflection rating at 25% compression is 16 to 25 psi. It absorbs the impact of a pitched ball if the bunt guard is hit, while keeping the guard in place. Polycarbonate is a suitable choice for the shield 2, as it is light weight and extremely tough, and has outstanding impact resistance, enhanced weather-ability and good abrasion resistance. Its tensile strength rate is up to 16,000 psi with a flexural modulus of 800,000 psi, and a notched izod impact rating of 16 ft-lb/in.

The shield 2 needs to easily attach and detach to all baseball and softball bats, no matter the length, shape or diameter. The solution for this is to utilize hook and loop strap material 5B with custom features for this application. The hook and loop strap 5B can be made with a knitted or woven base, allowing for non-slip polymer 6 to be securely applied to the strap back-side. It is applied in a liquid form, flowing around the open woven threads for superior adhesion, then cured, providing a secure grip to the ball bat 11, without slipping from its desired location. It is possible to utilize other non-slip materials 6, such as latex, rubber, A-scale polyurethane and other similar materials.

The practicing bunter places the barrel hand 10 behind the bunt guard 1, centered between the two hook and loop straps 5B, holding it to the bat 11. The straps 5B are spaced far enough apart, so the barrel hand 10 is entirely on the bat. The hook and loop straps 5B and applied non-slip coating 6 are preferably only about 0.04-0.05" thick, so as not to interfere with holding the ball bat 11, in the typical manner for bunting. The bunt guard 1 with hook and loop straps 5B provides guidance of the player's barrel hand 10 to the predetermined best holding location for each bat 11. The deflective curve 3 A, shaped convex to the round ball bat 11, allows ample space for the barrel hand 10 and fingers 12 to properly grip the ball bat 11, without contact with the shield 2. The non-slip material 6 has a tensile strength rating between about 450 psi-800 psi, and it would stretch as much as 1000%, if not for the strong bond to the hook and loop strap 5B.

While injection molding is the preferred manufacturing process for the shield, other techniques could be used including, stamping, compression forming, vacuum forming, and more. Other potential shield materials include metal alloys, nylon, polyolefins, polyurethanes or the like. As well, attachment alternatives for the bunt guard 1 exist, including elastic, cords, tape or other suitable materials. The current preferred embodiments have been found to be good combinations for producing the various components, with all functioning as designed and engineered, in a economical manner.

Various changes and modifications to the presently preferred embodiments disclosed herein will be apparent to those skilled in the art. Such changes and modifications may be made without departing from the spirit and scope of the present invention and without diminishing its attendant advantages. Therefore, the appended claims are intended to cover such changes and modifications, and are the sole limits on the scope of the invention.

We claim:

1. A bunt guard comprising a shield portion comprising a sheet of impact resistant polymeric material having two side edges and two end edges shorter than said side edges, said sheet being molded to provide an arcuate curved recess on a back surface parallel to said side edges, with a radius suitable to fit a portion of a ball bat for removable attachment thereto, and at least one curved surface on the opposite front surface effective to deflect a ball striking said shield portion while removably attached to a ball bat during bunting practice, plus two pairs of slots on each side of said recess to accommodate at least two straps for removably attaching said shield portion to a portion of a ball bat, said guard further comprising two straps adapted to fit said pairs of slots for attaching said shield portion to said bat.

2. The bunt guard of claim 1 wherein said straps comprise woven and/or knit fabric and hook-and-loop material for securing said shield portion in position on one side of said straps and a nonslip surface on the other side.

3. The bunt guard of claim 1 wherein said recess is lined with a polymeric material having nonskid and shock absorbent properties.

* * * * *